United States Patent [19]

Stagg, Jr. et al.

[11] Patent Number: 4,630,213

[45] Date of Patent: Dec. 16, 1986

[54] METHOD OF REDUCING THROUGHPUT OF SPINNING PUMPS

[75] Inventors: Lester P. Stagg, Jr.; William T. Windley, both of Seaford, Del.

[73] Assignee: E. I. Du Pont de Nemours and Company, Wilmington, Del.

[21] Appl. No.: 730,066

[22] Filed: May 3, 1985

Related U.S. Application Data

[63] Continuation-in-part of Ser. No. 537,480, Sep. 30, 1983, abandoned.

[51] Int. Cl.[4] ..... B29C 31/04; B29C 47/92; G06F 3/14

[52] U.S. Cl. ..... 364/470; 264/40.7; 425/145

[58] Field of Search ..... 264/40.1, 40.7, 210.8; 425/145; 364/473, 470, 469

[56] References Cited

U.S. PATENT DOCUMENTS

| | | |
|---|---|---|
| 3,429,491 | 2/1969 | Windley . |
| 3,555,537 | 1/1971 | Windley . |
| 3,557,349 | 1/1971 | Griem, Jr. . |
| 3,560,178 | 2/1971 | Minkler . |
| 3,683,160 | 8/1972 | Windley . |
| 3,811,261 | 5/1974 | Felix . |
| 4,195,790 | 4/1980 | Reiners et al. . |

FOREIGN PATENT DOCUMENTS

| | | |
|---|---|---|
| 131280 | 6/1978 | Japan . |
| 58-99436 | 12/1984 | Japan . |
| 517665 | 1/1975 | U.S.S.R. . |
| 651055 | 12/1976 | U.S.S.R. . |
| 705339 | 3/1977 | U.S.S.R. . |
| 0558975 | 7/1977 | U.S.S.R. . |
| 730890 | 8/1978 | U.S.S.R. . |
| 0931832 | 5/1982 | U.S.S.R. . |

*Primary Examiner*—Jan Silbaugh
*Assistant Examiner*—Karen D. Kutach

[57] ABSTRACT

A method of providing automatic positional control spinning pump throughput on a multiposition spinning machine during periods of yarn interruption by sensing yarn breaks and reducing spinning pump speed by a predetermined amount.

1 Claim, 5 Drawing Figures

METHOD OF REDUCING THROUGHPUT OF SPINNING PUMPS

This application is a continuation-in-part of our copending application Ser. No. 537,480 and now abandoned.

BACKGROUND OF THE INVENTION

The invention relates to processes for producing fibers from synthetic polymer, and more particularly, it relates to monitoring these processes to provide positional control of polymer throughput.

In the past, it has been a common practice to provide power, to polymer or solution spin pumps on spinning machine positions, at a drive frequency and voltage required to produce the desired throughput and fiber denier. Many pumps have been driven by a single drive for product consistency, uniformity, and simplicity. During time periods when fiber production has been interrupted, as a result of process breaks or positional maintenance, spin pumps have continued to operate at full throughput causing a loss of ingredients and production of excessive waste. Alternatively, spin pumps can be shut down completely for breaks or maintenance but experience has shown that shutting down positional spin pumps for substantial periods of time can lead to excessive costs related to loss of spin pack, freezing of polymer in transferlines, and general degradation and loss of control of polymer quality. Furthermore, when a pump which has been shut down is restarted, the polymer temperature and quality is off standard for a time related to the length of the shutdown. In addition, when a number of spinning positions of a multiposition machine are shut down simultaneously, the flow of polymer through the common manifold supplying the positions which are still operating is slowed to a point at which the chemical and/or physical properties of the product from the operating positions may be affected, or the polymer supply system can be adversely affected in other ways.

SUMMARY OF THE INVENTION

This invention provides an automatic positional control of spin pump throughput of a multiposition fiber producing machine during break periods or when maintenance is required by sensing discontinuities and reducing the spin pump speed to a predetermined level, preferably about 40–60% of normal operating level, if few other positions of the machine are similarly reduced. A computer determines whether a predetermined permissible number of positions is operating at reduced throughput, and if so, the position having the most recent break is maintained at normal throughput until one or more of the positions operating at reduced throughput resumes normal operation. At such time, the position having the break may be reduced to the predetermined throughput.

The process is monitored by appropriate sensing devices and if a discontinuity is indicated (loss of power, yarn break, speed deviation, etc.) a signal is transmitted to a pre-programmed microprocessor or computer which senses signals indicating discontinuities and selectively enables drive switching elements to transfer spin pump motor power from a production speed controlling drive to a second drive with reduced frequency and voltage output. Information stored in the microprocessor memory related to other positions operating at reduced throughput determines whether or not an enabling signal will be transmitted to drive switching elements permitting positional throughput reduction at any given time.

DETAILED DESCRIPTION OF THE ILLUSTRATED EMBODIMENT

Figure 1:
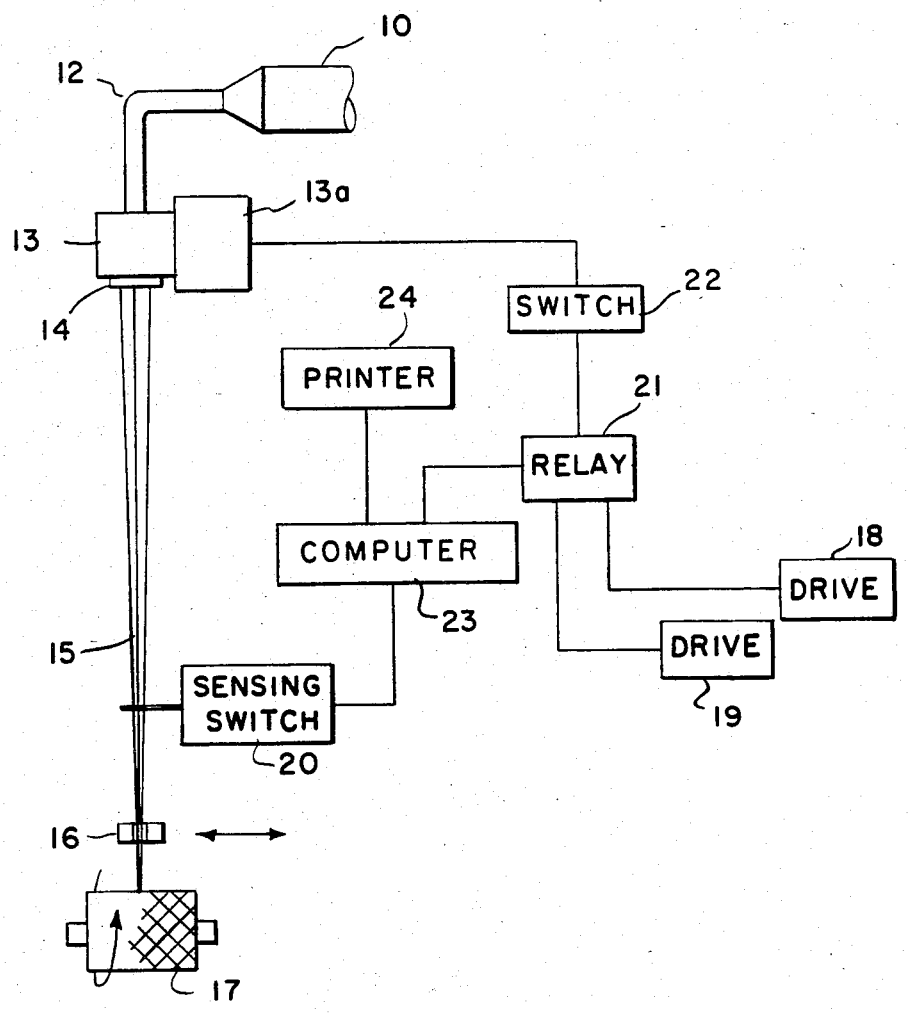
FIG. 1 is a schematic drawing of the system of this invention coupled to a single position of a melt spinning machine.

In one method chosen for purposes of illustration (FIG. 1) a molten polymer is supplied from manifold 10, through a transfer line 12, spinning pump 13 and spinneret 14 to produce threadline 15 comprised of multiple filaments of yarn extruded from spinneret 14. The threadline 15 advances through a traversing guide 16 to an individual windup where it is wound as a package 17. Electric motor **13*a* drives spinning pump 13 at a speed regulated by drives 18 or 19 which in turn are connected to the motor 13*a* through relay 21, and switch 22. A yarn sensing switch 20 is positioned in threadline 15 to detect the absence or presence of the threadline and is connected to computer 23. The computer 23 is interfaced with the yarn sensing device, the relay 21 and display module or printer 24**.

The control components of the apparatus are commercially available items. Typical components are as follows:

| ELEMENT CODE | ELEMENT NAME | COMMERCIAL IDENTIFICATON |
|---|---|---|
| 18 | Production Drive | Borg-Warner Type C-40 |
| 19 | Reduced Frequency Drive | PTI Model 6300 Drive |
| 20 | Sensing Switch | Micro Type BZ-2RW84-8223 |
| 21 | Relay | Square D, Class AO-1-D 4373-511-207503-LS |
| 22 | Manual Cutdown Switch | Square D, Class 9001, Type T-A |
| 23 | Microprocessor/ Controller | Gould-Modicon Model 484 |
| 24 | Printer | Digital Dec Writer No. III |

In operation, when threadline 15 breaks or is otherwise missing yarn sensing switch 20 sends a signal to the controller 23 which determines, as more fully described below, whether or not an enabling signal will be transmitted to relay 21. Relay 21, if activated, connects drive 19 to motor **13*a*. Drive 19 which operates a reduced frequency causes the speed of motor 13*a* to be reduced and as a consequence throughput is reduced. During maintenance periods, motor 13*a* can be deenergized manually by activation of switch 22**.

Figure 2:
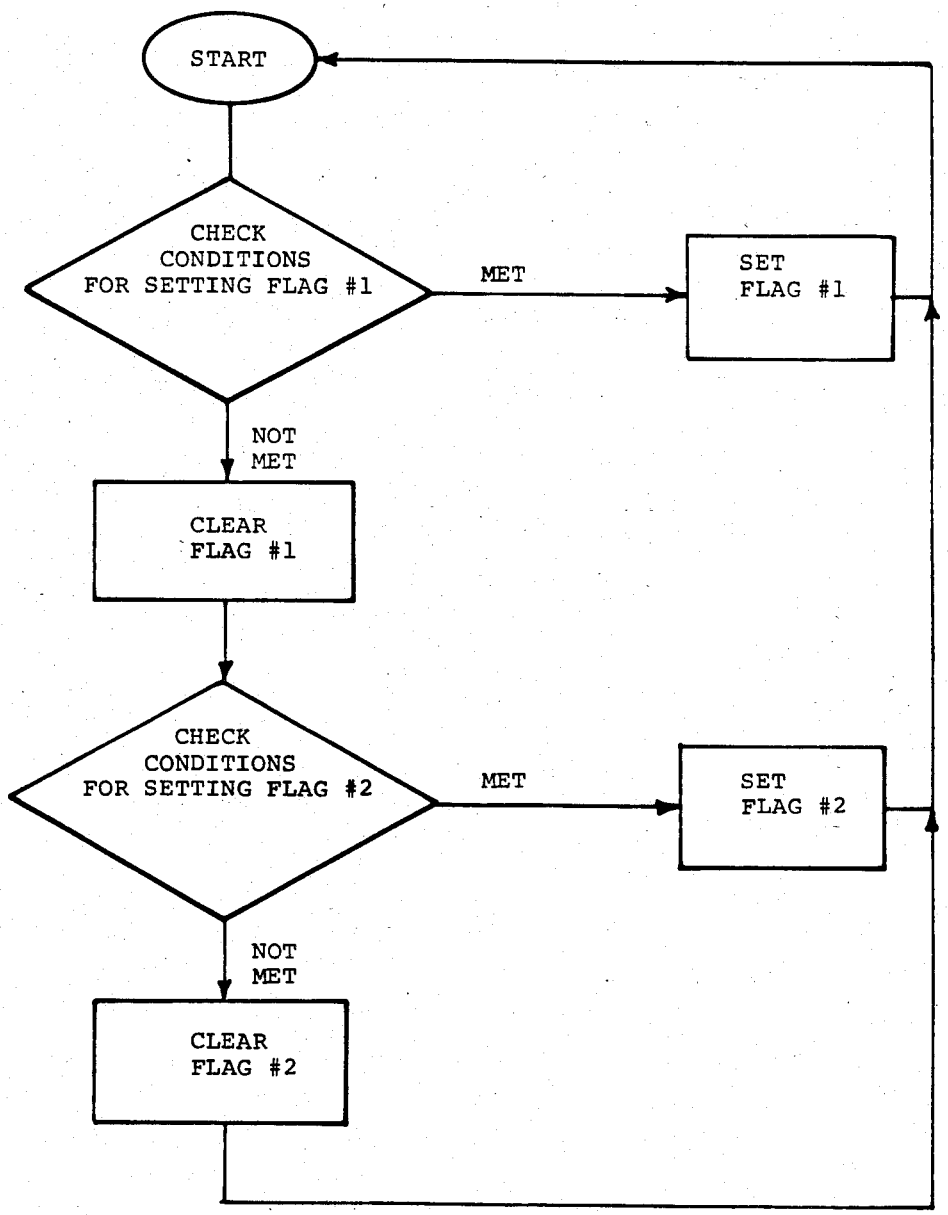
FIGS. 2–4 are computer logic flow diagrams.
Figure 3:
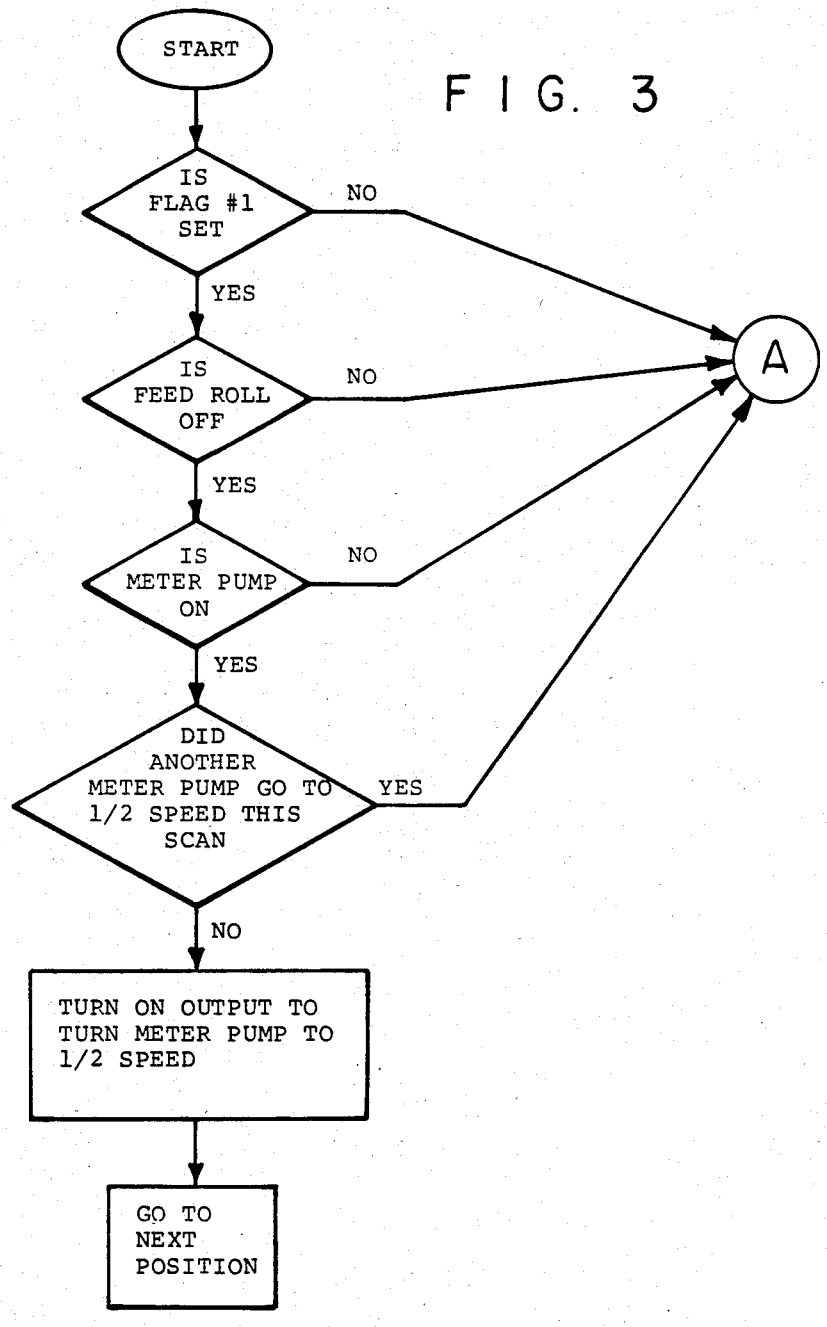
Figure 4:
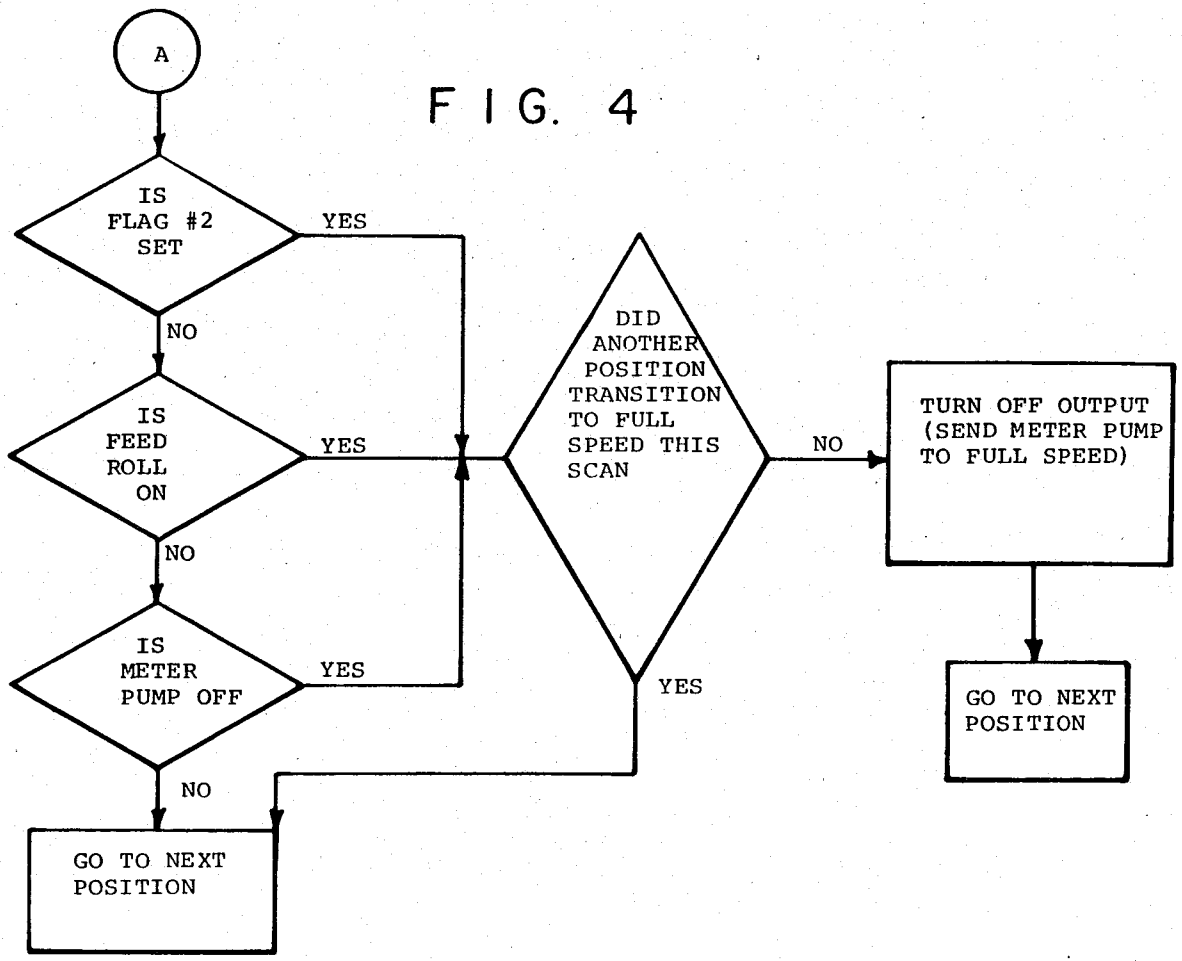

The computer interfaces with sensing device 20 and relay 21 and information stored in the computer relating to other positions of the spinning machine operating at reduced throughput determines whether or not an enabling signal will be transmitted to relay 21 permitting motor **13*a* to be connected to the reduced speed drive 19. Upon command the computer 23 transmits data to printer 24** for display. A description of the logic control flow charts to accomplish this is as follows:

The logic for automatic control of spinning machine throughput can be broken into two categories, general logic (FIG. 2) (which looks at the combined status of all (28) positions), and specific logic (FIGS. 3 and 4) (which looks at only one of the 28 virtually identical sets of specific logic; one set for each position. The general logic looks at the overall situation (e.g., how many pumps are off), and as a result of this information and the status of the mode selection switch, sets or clears two flags which operate in the following manner:

When flag No. 1 is on, this says to the position logic that if conditions (at the position) indicate, then the position can go to ½ speed. When off, this flag says no further positions can go to half speed.

When flag No. 2 is on, this says that if any positions are at ½ speed, then one of those positions must return to full speed. When off, this flag simply says no further positions have to go to full speed.

Flags 1 and 2 may both be off but only one can be on. They are, by definition, mutually exclusive.

Figure 5:
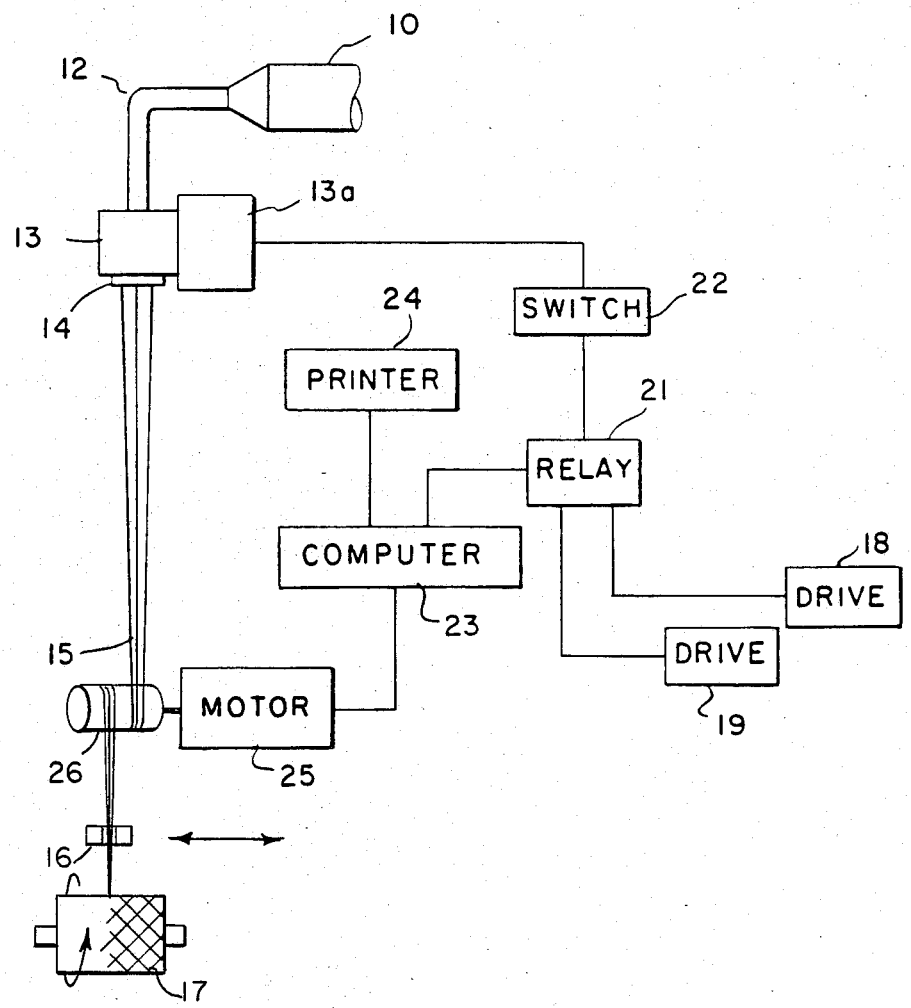
FIG. 5 is a schematic drawing of another preferred embodiment of the system of this invention.

In another preferred embodiment the loss of power to a motor driving a feed roll in the threadline triggers the throughput reduction. As shown in FIG. 5, feed roll motor 25 is coupled to feed roll 26 which when driven in the direction indicated by the arrow forwards filaments 15 to traverse mechanism 16. The computer 23 is now interfaced with the motor 25. In operation, when the motor 25 is deenergized a control signal is initiated and transmitted to computer 23 which then operates in the manner described above in connection with the logic diagrams of FIGS. 2–4. In this case, the restarting of motor 25 automatically brings motor 13*a* back to full energization and as a consequence pump 13 back to full throughput.

In a series of tests it has been determined, for example, that four of a total of twenty-eight positions can be operated at 50% throughput without negative effects. In other situations, the number of positions on reduced throughput and the degree of reduction may differ depending on the quality requirements of the particular products, the characteristics of the spinning equipment and the costs involved.

The process of the invention not only reduces waste but maintains the positions on reduced throughput in condition to make standard product as soon as they are returned to normal operation.

While two preferred methods have been described, it should be understood that interruptions of other machine functions or other indications of loss of threadline could be used to trigger the reduction of throughput described in this system.

We claim:

1. A method for reducing throughput of one or more spinning pumps in a multiposition spinning machine having a spinning pump at each position in response to yarn interruption signals from a spinning position wherein said spinning pumps are driven by individual electric motors energized from a common source supplying a set frequency and voltage, said method comprising: transmitting said signals to a microprocessor; scanning said multiposition spinning machine to determine the number of yarn interruption signals occurring at any given time; comparing the number of yarn interruptions to a predetermined number; and reducing the frequency and voltage supplied to the electric motor driving the spinning pump supplying the position signalling a yarn interruption by connecting said motor to an alternate source supplying a frequency and voltage lower than the common source supplying said set voltage and said set frequency to reduce the speed of the spinning pump when the yarn interruption signals do not exceed said predetermined number.

* * * * *